US005773206A

United States Patent [19]

Hershey et al.

[11] Patent Number: 5,773,206

[45] Date of Patent: Jun. 30, 1998

[54] INFRARED SENSOR DETECTABLE IMAGING ELEMENTS

[75] Inventors: Stephen A. Hershey, Fairport; James C. Bolthouse, Spencerport; Robert E. Dickerson, Hamlin, all of N.Y.

[73] Assignee: Eastman Kodak Company, Rochester, N.Y.

[21] Appl. No.: 840,517

[22] Filed: Apr. 21, 1997

[51] Int. Cl.[6] ..... G03C 1/76; G03C 5/16

[52] U.S. Cl. ..... 430/510; 430/567; 430/944; 430/963; 430/966

[58] Field of Search ..... 430/510, 966, 430/963, 944, 567

[56] References Cited

U.S. PATENT DOCUMENTS 5,260,178 11/1993 Harada et al. ..... 430/508

5,637,447 6/1997 Dickerson et al. ..... 430/567

*Primary Examiner*—Mark F. Huff

*Attorney, Agent, or Firm*—Carl O. Thomas

[57] ABSTRACT

An element capable of forming a silver image is disclosed containing insufficient radiation-sensitive silver halide grains to render the element detectable by an infrared sensor. The element has been modified to increase infrared specular density by the inclusion of, in a hydrophilic colloid dispersing medium, particles (a) being removable from the element during a rapid access processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2.

11 Claims, No Drawings

INFRARED SENSOR DETECTABLE IMAGING ELEMENTS

FIELD OF THE INVENTION

The invention pertains to imaging elements containing radiation-sensitive silver halide intended to form silver images when imagewise exposed and subjected to rapid access processing.

DEFINITIONS

In referring to silver halide grains or emulsions containing two or more halides, the halides are named in order of ascending concentrations.

The terms "high bromide" and "high chloride" in referring to silver halide grains and emulsions indicate greater than 50 mole percent bromide or chloride, respectively, based on total silver.

The term "equivalent circular diameter" or "ECD" indicates the diameter of a circle having an area equal to the projected area of a grain or particle.

The term "size" in referring to grains and particles indicates, unless otherwise described, indicates ECD.

The term "compact" in referring to grains and particles indicates a ratio of major (longest) to minor (shortest) axes of less than 2.

The terms "rapid access processing" and "rapid access processor" are employed to indicate a capability of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "dual-coated" refers to an element that has radiation-sensitive emulsion layers coated on both sides of a support.

The terms "front" and "back" refer to the sides of the element oriented nearer or farther, respectively, from the source of exposing radiation than the support. When an element is exposed concurrently to light and X-radiation, "front" and "back" are referenced to the X-radiation. One layer is "behind" another, when it is located to receive exposing radiation subsequent to another layer.

The term "specular density" refers to the density an element presents to a perpendicularly intersecting beam of radiation where penetrating radiation is collected within a collection cone having a half angle of less than 10°, the half angle being the angle that the wall of the cone forms with its axis, which is aligned with the beam. For a background description of density measurement, attention is directed to Thomas, *SPSE Handbook of Photographic Science and Engineering*, John Wiley & Sons, New York, 1973, starting at p. 837.

*Research Disclosure* is published by Kenneth Mason Publications, Ltd., Dudley House, 12 North St., Emsworth, Hampshire P010 7DQ, England.

BACKGROUND

A number of varied photographic film constructions have been developed to satisfy the needs of medical diagnostic imaging. The common characteristics of these films is that they (1) produce viewable silver images having maximum densities of at least 3.0 and (2) are designed for rapid access processing.

Roentgen discovered X-radiation by the inadvertent exposure of a silver halide photographic element. The discovery led to medical diagnostic imaging. In 1913 the Eastman Kodak Company introduced its first product specifically intended to be exposed by X-radiation. Shortly thereafter it was discovered that the films could be more efficiently employed in combination with one or two intensifying screens. An intensifying screen is relied upon to capture an image pattern of X-radiation and emit light that exposes the radiographic element. Elements that rely entirely on X-radiation absorption for image capture are referred to as direct radiographic elements, while those that rely on intensifying screen light emission, are referred to as indirect radiographic elements. Silver halide radiographic elements, particularly indirect radiographic elements, account for the overwhelming majority of medical diagnostic images.

In recent years a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light emitting diode (LED) or a light bar (a linear series of independently addressable LED's). The image is recreated as a series of laterally offset pixels. Initially the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped for rapid access processing of radiographic films and are familiar with their image characteristics.

Rapid access processing can be illustrated by reference to the Kodak X-OMAT 480 RA™ rapid access processor, which employs the following (reference) processing cycle:

development 24 seconds at 35° C.

fixing 20 seconds at 35° C.

washing 20 seconds at 35° C.

drying 20 seconds at 65° C.

with up to 6 seconds being taken up in film transport between processing steps.

A typical developer employed in this processor exhibits the following composition:

hydroquinone 30 g 1-phenyl-3-pyrazolidone 1.5 g

KOH 21 g $NaHCO_3$ 7.5 g $K_2SO_3$ 44.2 g $Na_2S_2O_3$ 12.6 g

NaBr 35.0 g 5-methylbenzotriazole 0.06 g glutaraldehyde 4.9 g water to 1 liter at a pH 10.0.

A typical fixer employed in this processor exhibits the following composition:

$Na_2S_2O_3$ in water at 60% of total weight in water 260.0 g $NaHSO_3$ 180.0 g boric acid 25.0 g
acetic acid 10.0 g
water to 1 liter at a pH of 3.9–4.5.

Numerous variations of the reference processing cycle (including, shorter processing times and varied developer and fixer compositions) are known.

Rapid access processors are typically activated when an imagewise exposed element is introduced for processing. Silver halide grains in the element interrupt an infrared sensor beam in the wavelength range of from 850 to 1100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. When the processed element emerges from the processor, an infrared sensor placed near the exit of the processor receives an uninterrupted infrared beam and shuts down the processor until another element is introduced requiring processing.

When medical diagnostic films are constructed with relatively small mean silver halide grains sizes, as is being done to an increasing extent in recreating digitally stored images, relatively low grain coating densities are capable of satisfying maximum density requirements. For example, coating coverages of less than 50 mg/dm$^2$ (5 g/m$^2$), based on the total weight of silver, are attainable.

While lower silver coating coverages are in themselves advantageous in saving materials and facilitating rapid access processing, the low silver coverages have presented a problem in using commercially available rapid access processors. Low silver films present essentially similar problems in other film handling equipment that employ the same types of sensors. Such film handling equipment includes exposure (e.g., laser exposure) equipment for recreating images from digitally stored image information, automatic film loading equipment for loading film in cassettes, and automatic film advance equipment, where film is advanced between imagewise exposures rather than handled as separate sheets loaded into cassettes.

Harada et al U.S. Pat. No. 5,260,178 has noted that if the silver coating coverage of a radiographic element is less than 5 g/m$^2$, it is impossible for sensors that rely on the scattering of near infrared sensor beams by silver halide grains to sense the presence of the film in the processor. The solution proposed is to incorporate an infrared absorbing dye. Instead of reducing specular density by scattering near infrared radiation, the dye simply absorbs the near infrared radiation of the sensor beam. During processing the dye is deaggregated to shift its absorption peak. In the later stages of processing the density of developed silver is relied upon for interrupting sensor beams, which is the conventional practice. The difficulty with the Hirada et al solution to the problem of insufficient silver halide grain coating coverages to activate infrared sensors is that it relies on the addition of a complex organic material—specifically a tricarbocyanine dye that must have, in addition to the required chromophore for near infrared absorption, a steric structure suitable for aggregation and solubilizing substituents to facilitate deaggregation. The dyes of Hirada et al also present the problem of fogging the radiation-sensitive silver halide grains when coated in close proximity, such as in a layer contiguous to a radiation-sensitive emulsion layer. Simply stated, the burden of the "cure" that Hirada proposes is sufficiently burdensome as to entirely offset the advantage of reduced silver coating coverages, arrived at by years of effort by those responsible for improving films for producing silver images in response to rapid access processing. Thus, Hirada's film structure modification is not a problem solution that has practical appeal.

SUMMARY OF THE INVENTION

In one aspect this invention is directed to an element capable of producing silver images having a maximum density of at least 3.0 in response to imagewise exposure to visible light and processing in a reference processing cycle. The element is comprised of a transparent film support and, coated on the support, hydrophilic colloid layers including, dispersed in at least one layer, compact radiation-sensitive silver halide grains (a) exhibiting a mean size of less than 0.5 $\mu$m, (b) containing less than 3 mole percent iodide, based on silver, and (c) coated at a total silver coating coverage of less than 50 mg/dm$^2$, wherein the specular density of the element to infrared radiation in the wavelength range of from 850 to 1100 nm is increased by the presence of compact particles dispersed in at least one of the hydrophilic colloid layers positioned to receive imagewise exposure to visible light after at least one of the hydrophilic colloid layers containing said radiation-sensitive silver halide grains, the particles (a) being removable from the element during the reference processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2. The reference processing cycle consists of development 24 seconds at 35° C.
fixing 20 seconds at 35° C.
washing 20 seconds at 35° C.
drying 20 seconds at 65° C.

with up to 6 seconds being taken up in film transport between processing steps, development employing the following composition:

hydroquinone 30 g
1-phenyl-3-pyrazolidone 1.5 g
KOH 21 g
$NaHCO_3$ 7.5 g
$K_2SO_3$ 44.2 g
$Na_2S_2O_3$ 12.6 g
NaBr 35.0 g
5-methylbenzotriazole 0.06 g
glutaraldehyde 4.9 g
water to 1 liter at a pH 10.0, and fixing employing the following composition:

$Na_2S_2O_3$ in water at 60% of total weight 260.0 g
$NaHSO_3$ 180.0 g
boric acid 25.0 g
acetic acid 10.0 g
water to 1 liter at a pH of 3.9–4.5.

A distinct advantage of the present invention is that specular density in the common infrared wavelength ranges (850 to 1100 nm) of photosensors controlling rapid access processors is increased in low silver coating coverage imaging elements by incorporating particles that are practically attractive as compared to (a) increasing the coating coverage of the radiation-sensitive silver halide grains above 50 mg/dm$^2$ or (b) adding infrared absorbing dye.

As compared to the infrared absorbing dyes of Hirada et al, the particles can be selected from among a wide variety of compositions, all much easier to obtain than tricarbocyanine dyes. Since the particles rely on selected sizing to increase specular density rather than absorbing near infrared radiation, it is not necessary to provide the complex dye chromophore structure required for near infrared absorption.

Surprisingly, the particles are more efficient than the radiation-sensitive silver halide grains in attenuating near infrared radiation. Thus, even when the particles themselves consist of silver halide, they are capable of increasing specular density with overall silver coverages, including both grains and particles, that are less than would be required to achieve the same specular density employing only the radiation-sensitive grains.

When the radiation-sensitive grains are high chloride grains, employing high bromide silver halide particles provides an even larger overall silver coating coverage reduction.

Finally, it is specifically contemplated to select the particles from among structurally simple and commonplace materials as compared to the dyes of Hirada et al and silver halide. Thus, in a specifically contemplated form, the invention requires no overall increase in silver coating coverages to increase specular density in the low silver coating coverage elements of the invention.

PREFERRED EMBODIMENTS

The present invention is generally applicable to increasing the specular density to near infrared radiation in the wavelength range of from 850 to 1100 nm of any conventional imaging element capable of producing by rapid access processing a maximum silver image density of at least 3.0 containing a transparent film support and, coated on the support, hydrophilic colloid layers including compact radiation-sensitive silver halide grains (a) exhibiting a mean size of less than 0.5 $\mu$m, (b) containing less than 3 mole percent iodide, based on silver, and (c) coated at a total silver coating coverage of less than 50 mg/dm$^2$.

The specular density of the element to infrared radiation in the wavelength range of from 850 to 1100 nm is increased by the presence of compact particles dispersed in at least one of the hydrophilic colloid layers. The particles have a mean size of from 0.3 to 1.1 $\mu$m and at least 0.1 $\mu$m larger than the mean grain size of the radiation-sensitive grains, and have an index of refraction at the wavelength of the infrared radiation that differs from the index of refraction of the hydrophilic colloid by at least 0.2. The particles are additionally chosen to be removable during rapid access processing, since they are no longer needed or desirable in the element after a silver image is developed in the element.

The following represents a support and layer arrangement compatible with elements satisfying the requirements of the invention:

| (I) |
|---|
| Front Hydrophilic Colloid Layer Unit |
| Transparent Film Support |
| Back Hydrophilic Colloid Layer Unit |

While the transparent film support in its simplest form can consist of any flexible transparent film, it is common practice to modify the surfaces of photographic and radiographic film supports by providing subbing layers to promote the adhesion of hydrophilic colloids to the support. Although any conventional photographic film support can be employed, it is preferred to employ a radiographic film support, since this maximizes compatibility with the rapid access radiographic film processors in which the films of the invention are intended to be processed and provides a radiographic film look and feel to the processed film. Radiographic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processed films, whereas photographic films rarely, if ever, employ blue tinted supports. Radiographic film supports, including the incorporated blue dyes that contribute to cold image tones, are described in *Research Disclosure*, Vol. 184, August 1979, Item 18431, Section XII. Film Supports. *Research Disclosure*, Vol. 389, September 1994, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthenate) are specifically preferred polyester film supports.

It is conceptually possible to construct the front hydrophilic colloid layer unit of a single hydrophilic colloid layer having dispersed therein radiation-sensitive silver halide grains—i.e., a single radiation-sensitive silver halide emulsion layer. In practice, the front hydrophilic colloid layer unit more typically exhibits the following structure:

| (FHCLU-I) |
|---|
| Surface Overcoat |
| Interlayer |
| Radiation-sensitive Emulsion Layer(s) |

Similarly, the back hydrophilic colloid layer unit can consist of a single hydrophilic colloid layer, but, preferably, the back hydrophilic colloid layer unit is also formed of a plurality of hydrophilic colloid layers.

When the radiation-sensitive emulsion or emulsions are confined to the front hydrophilic colloid layer unit, the following represents a typical preferred back hydrophilic colloid layer unit:

| (BHCLU-I) |
|---|
| Pelloid |
| Interlayer |
| Surface Overcoat |

Thus, a preferred element satisfying the requirements of the invention exhibits the following structure:

| (II) |
|---|
| Surface Overcoat |
| Interlayer |
| Radiation-sensitive Emulsion Layer(s) |
| Transparent Film Support |
| Pelloid |
| Interlayer |

-continued

| (II) |
| --- |
| Surface Overcoat |

When the element is intended to be imagewise exposed concurrently from both sides, as occurs when a dual-coated radiographic element is mounted between a pair of light-emitting intensifying screens, in the simplest possible construction, both the front and back colloid layer units can contain a single radiation-sensitive silver halide emulsion layer.

In practice it is usually preferred to construct the element as follows:

| (III) |
| --- |
| Surface Overcoat |
| Interlayer |
| Radiation-sensitive Emulsion Layer(s) |
| Crossover Control Layer |
| Transparent Film Support |
| Crossover Control Layer |
| Radiation-sensitive Emulsion Layer(s) |
| Interlayer |
| Surface Overcoat |

The surface overcoats and, particularly, the interlayers can be omitted from all of the constructions above. The pelloid and crossover control layers can be omitted with a loss in image sharpness. When at least two radiation-sensitive emulsion layers are present on one side of a dual-coated radiographic element, loss of image sharpness can be minimized by incorporating the crossover control function within the emulsion layer coated nearest the support.

All of the varied support and layer arrangements described above are conventional and fully compatible with the elements of the invention.

In the present invention all of the radiation-sensitive silver halide grains, whether in one or a plurality of emulsion layers, coated on one or both sides of the support, are compact grains (a) exhibiting a mean size of less than 0.5 $\mu$m, (b) containing less than 3 mole percent iodide, based on silver, and (c) coated at a total silver coating coverage of less than 50 mg/dm$^2$. At these coating coverages compact grains exhibiting a mean grain size of less than 0.5 $\mu$m exhibit only a limited capability of scattering infrared radiation in the wavelength range of from 850 to 1100 nm.

The compact grains can take any regular or irregular shape, so long as the ratio of the major and minor axes is less than 2. This includes cubic grains (regular grains bounded by {100} crystal planes), octahedral grains (regular grains bounded by {111} crystal planes), tetradecahedral grains (regular grains bounded by six {100} crystal planes and eight {111} crystal planes), singly and multiply twinned irregular grains, and grains that contain one or more screw dislocations. Most, if not all, of the compact grains are spatially oriented randomly in the emulsion layers. This distinguishes compact grains from non-compact grains, such as tabular grains that have an average aspect ratio of at least 2. The compact grains are preferably precipitated and coated to exhibit predominantly a single grain shape. Alternatively, the grains can be precipitated in mixed grain shapes, blended to produce grain populations of mixed grain shapes, or coated with grains of different shapes in different emulsion layers.

The grains can be monodisperse or polydisperse. As is generally recognized in the art, mean grain dispersity is typically chosen to realize desired levels of contrast and exposure latitude. When the elements are employed to reconstruct digitally stored images, it is usually preferred to limit the coefficient of variation (COV) of the mean grain sizes to less than 40 percent, most preferably less than 20 percent.

The grains can be of any desired halide composition, provided that they contain less than 3 (preferably 1) mole percent iodide, based on silver. Thus, grains consisting essentially of silver bromide, silver chloride or any combination of these two halides, with the grains either totally lacking iodide or containing iodide up to the concentration levels indicated, are contemplated. When the elements of the invention are intended to capture X-radiation images directly or indirectly for imagewise exposure, it is usually preferred to choose silver bromide or iodobromide grains to maximize sensitivity within the grain size ranges contemplated. When the elements are used to reconstruct digitally storaged images, it is generally preferable to employ high (>50 mole %) chloride grains to allow for even faster rates of development. Pure chloride emulsions are contemplated, but it has been discovered that higher levels of covering power (maximum density divided by silver coating coverage) are realized when at least 10 mole percent bromide, based on silver, is also present. Preferred grain compositions for digital imaging applications are silver bromochloride grains containing from 20 to 40 mole percent bromide.

The silver coating coverages of all the radiation-sensitive silver halide grains in the element, whether present in one or more emulsion layers, are less than 50 mg/dm$^2$, preferably less than 40 mg/dm$^2$. Useful silver images can be produced with silver coverages of radiation-sensitive grains down to 10 mg/dm$^2$, with coating coverages higher than 15 mg/dm$^2$ being most common.

The mean sizes of the radiation-sensitive grains are in all instances less than 0.5 $\mu$m. Adequate radiation-sensitivity for at least some imaging applications can be retained when mean grain sizes are reduced down to 0.1 $\mu$m. The present invention is particularly applicable to elements with mean sizes of the radiation-sensitive grains of less than 0.35 $\mu$m.

The detectability of the radiation-sensitive silver halide grains by infrared sensors in the 850 to 1100 nm wavelength range is a function of (1) the mean size of the radiation-sensitive grains, (2) the halide composition of the grains, and (3) the silver coating coverages of the radiation-sensitive grains. For example, at a minimum (10 mg/dm$^2$) silver coating coverage silver chloride radiation-sensitive grains are difficult to detect at mean grain sizes up to 0.5 $\mu$m. Silver bromide radiation-sensitive grains at mean sizes of 0.35 $\mu$m exhibit about the same level of light scattering as 0.5 $\mu$m mean ECD silver chloride grains. Grains containing chloride and bromide show intermediate scattering characteristics. The inclusion of iodide, at contemplated concentrations of up to 3 mole percent, based on silver, has no significant impact on the light scattering properties of silver iodobromide grains, but the inclusion of iodide can significantly increase the light scattering of silver iodochloride grains.

Illustrations of conventional compact radiation-sensitive silver halide grains satisfying the characteristics noted above and their preparations are illustrated by *Research Disclosure*, Item 38957, Section I. Emulsion grains and their preparation. The grains can form predominantly surface or internal latent images and can be used to form negative or direct-positive images. In the overwhelming majority of applications the grains are predominantly surface latent image forming negative-working grains.

The radiation-sensitive silver halide grains are conventionally chemically sensitized and, when exposed to light, which occurs when photodiodes, lasers, CRT screens, or intensifying screens are employed for exposure, the radiation-sensitive silver halide grains are usually also spectrally sensitized. High bromide grains, particularly those containing iodide, exhibit significant native blue sensitivity, but no significant green or red sensitivity. Since the most commonly used intensifying screens emit in the green and the most commonly used photodiodes and lasers emit in the red, in most instances the radiation-sensitive grains are spectrally sensitized. Even when the grains possess native blue sensitivity and are exposed to blue light, further speed enhancements are realized when blue spectral sensitizing dyes are employed. Preferred chemical and spectral sensitizations are disclosed in *Research Disclosure*, Item 38957, cited above, Section IV. Chemical sensitization and Section V. Spectral sensitization and desensitization.

To increase the specular density of the elements of the invention so that near infrared sensors can detect the presence of the elements in rapid access processors, it is contemplated to incorporate in the elements compact particles (a) removable from the element during the reference processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2.

The optimum mean particle size for scattering near infrared radiation in the sensor wavelength range is approximately 0.7 $\mu$m, but acceptable scattering is realized over the entire range of from 0.3 to 1.9 $\mu$m. A preferred particle size range for near infrared scattering is from 0.5 to 0.9 $\mu$m. To insure more efficient near infrared scattering than the radiation-sensitive silver halide grains, it is contemplated to chose compact particles that exhibit a mean size at least 0.1 $\mu$m larger than the mean size of the radiation-sensitive silver halide grains.

The ability of the compact particles to increase the specular density of the elements of the invention to near infrared radiation is in part a function of the mean size of the particles and in part determined by the mismatch, in the infrared wavelength region employed by the sensors, between the refractive indices the particles and the organic vehicle of the hydrophilic colloid layers in which they are dispersed. Organic vehicles and hardeners useful in the hydrophilic colloid layers of silver halide imaging elements are illustrated in *Research Disclosure*, Item 38957, cited above, Section II. Vehicles, vehicle extenders, vehicle-like addenda. The most commonly employed vehicles in silver halide imaging elements are gelatin, including pigskin gelatin as well as cattle bone and hide gelatin, and gelatin derivatives, such as acetylated or phthalated gelatin. Section II further lists a wide variety of organic materials employed in place of or, more typically, in combination with gelatino-vehicle. These organic vehicles typically have refractive indices in the range from about 1.40 to 1.75, most commonly 1.40 to 1.60. The refractive index of gelatin is generally 1.54.

To facilitate scattering of the near infrared sensor beam it is contemplated to employ particles that exhibit a refractive index difference, a compared to the, vehicle, of at least 0.2 and preferably at least 0.4. The higher the refractive index difference, the larger the degree of near infrared scattering. Thus, there is no reason for intentionally limiting the refractive index difference.

Although the particles are intended to scatter only near infrared radiation, it is recognized that they can also exhibit sufficient scattering of visible light, particularly at longer visible wavelengths, to degrade image sharpness when located to receive exposing light prior to the radiation-sensitive silver halide grains. It is therefore contemplated to locate the particles so that at least one hydrophilic colloid layer containing the radiation-sensitive silver halide grains will be positioned to receive exposing radiation prior to the particles. For example, if the element contains a single radiation-sensitive emulsion layer, the particles are located in a hydrophilic colloid layer behind the emulsion layer, coated on either the same side or the opposite side of the support as the emulsion layer. If the element contains two radiation-sensitive emulsion layers, it is possible, but not preferred to coat the particles in the second emulsion layer to receive exposing radiation. Preferably, the particles are located in a hydrophilic colloid layer that does not contain the radiation-sensitive silver halide grains, even when two or more radiation-sensitive emulsion layers are present in an element. When the particles are located in a layer or layers entirely behind the radiation-sensitive grains, they can exhibit significant levels of absorption in the wavelength region of exposing radiation.

A wide variety of materials are known that can be prepared in the indicated particle size range and exhibit refractive indices that differ from that of the vehicle present in the hydrophilic colloid layer. Of these materials, those that are removable during the reference processing cycle are specifically selected. If the particles remain in the film permanently, the image bearing element has an undesirable hazy appearance. A simple illustration of haze is provided by placing a newspaper behind an imaged film and attempting to read the text through the film. The newsprint can be read through a film exhibiting low haze, but can be read, if at all, only with difficulty through a hazy film.

In one form the particles are comprised of silver halide. Since the particles are not employed for latent image formation, they need not be and preferably are neither chemically nor spectrally sensitized. The silver halide particles can be chosen from among any of the silver halide compositions disclosed above in connection with the radiation-sensitive grains. As in the case of the grains, iodide in the silver halide particles is limited to 3 (preferably 1) mole percent or less, based on silver, to facilitate removal of the particles by fixing during rapid access processing. If the silver halide particles remain in the element after processing, they may printout when the element is placed on a light box for viewing, thereby objectionably raising minimum density. Since there is no advantage to iodide inclusion in the particles, it is specifically preferred that it be entirely eliminated or present in only impurity concentrations.

If very rapid processing is contemplated, requiring high chloride silver halide radiation-sensitive grains, then the elements can also benefit by choosing high chloride silver halide particles.

In considering the choice of silver halides to form the particles, the refractive indices of the various halides should be taken into account. The refractive index of AgCl is 2.07, of AgBr is 2.25, and of AgI is 2.22. The refractive index between the hydrophilic colloid vehicle and silver bromide particles is nearly 0.2 higher than between the vehicle and silver chloride particles. The addition of iodide increases the refractive index of high chloride particles, but does not increase the refractive index of high bromide particles. From the foregoing it is apparent that high bromide particles lacking iodide, particularly silver bromide particles, are preferred for all elements, except those intended for the most rapid processing.

An alternative to silver halide particles is represented by zinc oxide particles. The refractive index of zinc oxide is 2.0. Another alternative is cuprous oxide particles. Cuprous oxide has a refractive index of 2.7. Still another alternative is represented by cuprous chloride particles. Cuprous chloride has a refractive index of 1.93. Zinc oxide, cuprous oxide and cuprous chloride are all acid soluble in the presence of a fixer complexing agent, such as a thiosulfate. Hence these particles can be removed from the elements during fixing. These zinc and copper containing particles have the advantages of being (a) readily available, (b) environmentally acceptable, (c) chemically stable, and (d) compatible with silver halide imaging. There are, of course, a wide variety of other particle materials that can be substituted, but with some reduction of one or more of advantageous characteristics (a) through (d). There is, of course, no reason to employ materials, such as organic dyes or pigments, that are comparatively burdensome to prepare, or compounds of precious metals.

Any threshold amount of the particles that detectably increase specular density to near infrared radiation in the 850 to 1100 nm wavelength range can be employed. The amount required to raise the specular density of the element to the level of detectability by processor sensors will vary, depending on the level of specular density which the radiation-sensitive grains provide. Since the particles are more efficient in scattering near infrared radiation than the silver halide grains, it can be appreciated that, in all instances, the elements are detectable to processor sensors at particle coating coverages of 50 mg/dm$^2$. Typical particle coating coverages are contemplated to be in the range of from about 2 to 30 mg/dm$^2$.

The following is a preferred particle placement in element (II), described above:

| (IIa) |
|---|
| Surface Overcoat |
| Interlayer |
| Radiation-sensitive Emulsion Layer(s) |
| Transparent Film Support |
| Pelloid (Particles) |
| Interlayer |
| Surface Overcoat |

The following is a preferred particle placement in element (III), described above:

| (IIIa) |
|---|
| Surface Overcoat |
| Interlayer |
| Radiation-sensitive Emulsion Layer(s) |
| Crossover Control Layer (Particles) |
| Transparent Film Support |
| Crossover Control Layer (Particles) |
| Radiation-sensitive Emulsion Layer(s) |
| Interlayer |
| Surface Overcoat |

In a varied form, radiation-sensitive silver halide grains can also be coated in the crossover control layer, creating the following structure:

| (IIIb) |
|---|
| Surface Overcoat |
| Interlayer |
| 1st Radiation-sensitive Emulsion Layer |
| 2nd Radiation-sensitive Emulsion Layer |
| (Crossover Control Dye + Particles) |
| Transparent Film Support |
| 2nd Radiation-sensitive Emulsion Layer |
| (Crossover Control Dye + Particles) |
| 1st Radiation-sensitive Emulsion Layer |
| Interlayer |
| Surface Overcoat |

It is possible to place the particles in an interlayer or a surface overcoat to maximize the rate of removal of the particles during processing. However, it is generally preferred to place the particles in the layers indicated, since the interlayer and surface overcoat layer typically contain varied conventional addenda for modifying physical property characteristics.

Conventional hydrophilic colloid vehicle coating coverages are compatible with the element structures of the invention. Dickerson et al U.S. Pat. No. 4,900,652 teaches rapid access processing with hydrophilic colloid coverages per side of less than 65 mg/dm$^2$, preferably less than 45 mg/dm$^2$. Conveniently hydrophilic colloid coverages on any one side of the support can range as low the combined coating coverages of the radiation-sensitive grains and the particles incorporated on that one side. In the preferred element constructions II and III (including a and b variants) hydrophilic colloid coatings are present on both the front and back sides of the support. By providing at least approximately similar hydrophilic colloid coverages on the opposite sides of the support, the elements are protected from curl. When a support is sufficiently rigid to resist curl or curl is otherwise controlled, the hydrophilic colloid layers can be coated entirely on one side of the support.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II. Emulsion Stabilizers, Antifoggants and Antikinking Agents.

The surface overcoats are typically provided for physical protection of the emulsion and pelloid layers. In addition to vehicle features discussed above the overcoats can contain various addenda to modify the physical properties of the overcoats. Such addenda are illustrated by *Research Disclosure*, Item 38957, IX. Coating physical property modifying addenda, A. Coating aids, B. Plasticizers and lubricants, C. Antistats, and D. Matting agents. The interlayers are typically thin hydrophilic colloid layers that provide a separation between the emulsion or pelloid (particularly the former) and the surface overcoat addenda.

The pelloid layer is a preferred location for antihalation dyes. Such dyes are illustrated by *Research Disclosure*, Item 38957, Section VIII. Absorbing and scattering materials, B. Absorbing materials. The antihalation dyes absorb light that has passed through the emulsion layer to minimize light reflection and the associated reduction in image sharpness. Antihalation dyes are chosen to be decolorized during processing.

When an antihalation dye is coated between an emulsion layer and the support, it performs the same function as when coated on the back side of the support. When radiation-sensitive silver halide grains are coated on only one side of the support, increased processing rates are realized when the antihalation dye is contained on the opposite side of the support. When an element is dual coated, such as element III, the dyes used as antihalation dyes are also useful to control crossover.

EXAMPLES

The invention can be better appreciated by reference to the following specific embodiments. Coating coverages in units of mg/dm$^2$ are shown in parenthesis and in units of mg/ft$^2$ are shown in brackets. Silver halide coating coverages are reported in terms of silver. The suffix C is applied to comparative elements, and the suffix E is applied to elements that satisfy the requirements of the invention. Cubic grains sizes are reported in terms of edge lengths.

Element 1C

The following element was constructed:

SOC Layer
Emulsion Layer
Blue 7 mil (178 μm) Estar ™ Support
Pelloid Layer
PSC Layer Estar ™ is poly(ethylene terephthalate)

SOC Layer

| | | |
|---|---|---|
| gelatin | [82.4] | (8.9) |
| poly(methyl methacrylate) matte 1.5 μm mean ECD | [3.2] | (0.34) |
| poly(methyl methacrylate) matte 2.5 μm mean ECD | [1.4] | (0.15) |
| poly(dimethyl siloxane) | [1.3] | (0.14) |
| NaOH | [0.42] | (0.045) |
| SOC-1 | [2.25] | (0.24) |
| SOC-2 | [0.06] | (0.0064) |

SOC-1 a mixture of
t-$C_8H_{17}$-ϕ-O—(Et—O)$_x$Hx = 3 and
t-$C_8H_{17}$-ϕ-O—(Et-O)$_2$—Et—$SO_3Na$
where
Et = ethylene
ϕ = phenylene

SOC-2 a mixture of
$R_f$—Et—S—CH($CO_2H$)$CH_2$—CONH(Me)$_3$—N($CH_3$)$_2$ and
$R_f$—Et—S—CH($CO_2H$)—CONH(Me)$_3$—N($CH_3$)$_2$
where
$R_f$ = a mixture of $C_6H_{13}$, $C_8F_{17}$ and $C_{10}F_{21}$
Me = methylene Emulsion Layer

| | | |
|---|---|---|
| gelatin | [230.00] | (24.7) |
| $AgCl_{0.70}Br_{0.30}$ 0.28 μm cubes | [260.00] | (30.0) |
| EL-1 | [0.40] | (0.043) |
| EL-2 | [0.17] | (0.018) |
| KI | [0.97] | (0.10) |
| $KNO_3$ | [1.81] | (0.19) |
| EL-3 | [7.23] | (0.78) |
| resorcinol | [10.52] | (1.13) |
| EL-4 | [0.24] | (0.025) |
| EL-5 | [8.76] | (0.94) |

EL-1 anhydro-3,3'-bis(3-sulfopropyl)-9-ethyl-4,5;4',5'-dibenzo-thiacarbocyanine hydroxide, sodium salt

EL-2 anhydro-3,3'-bis(3-sulfopropyl)-5,5'-dichloro-9-ethyl-thiacarbocyanine hydroxide

EL-3

-continued 4-hydroxy-6-methyl-2-mercapto-1,3,3a,7-tetraazaindene

EL-4 bis[3-ethyoxycarbonyl-1-(4-sulfophenyl)-2-pyrazolin-5-one] pentamethineoxonol, trisodium salt

EL-5 bis(vinylsulfonylmethyl)ether

Pelloid Layer

| | | |
|---|---|---|
| gelatin | [309.00] | (33.2) |
| PL-1 | [4.78] | (0.51) |
| PL-2 | [9.23] | (0.99) |
| NaOH | [0.12] | (0.013) |
| EL-4 | [8.76] | (0.94) |

PL-1 bis[3-methyl-1-(p-sulfophenyl)-2-pyrazolin-5-one-(4)] pentamethine oxonol

PL-2 bis[3-acetyl-1-(2,5-disulfophenyl)-2-pyrazolin-5-one-(4)]-pentamethine oxonol, pentasodium salt PSC Layer

| | | |
|---|---|---|
| gelatin | [41.24] | (4.44) |
| polystyrene matte 5.5 μm | [4.00] | (0.43) |
| colloidal silica | [12.36] | (1.33) |
| NaOH | [0.22] | (0.23) |
| poly(dimethyl siloxane) | [1.11] | (0.12) |
| silicone polyethylene glycol | [5.27] | (0.57) |
| PSC-1 | [8.05] | (0.87) |
| $CF_3SO_3^-Li^+$ | [7.05] | (0.76) |
| PSC-2 | | |
| $C_{12}H_{25}OSO_3^-Na^+$ | [0.42] | (0.045) |
| $C_{12-16}H_{25-33}$—O—(Et—O)$_4$—Et—OH | [0.64] | (0.069) |

PSC-1 a mixture of
$C_9H_{19}$-ϕ-O—[$CH_2CH(OH)CH_2O]_{10}$H and
$C_9H_{19}$-ϕ-O—[$CH_2CH(CHOH)O]_{10}$H

PSC-2

F($CF_2CF_2$)$_{3-8}$—Et—O-(Et—O)$_x$H x = 8–12

Element 2E

This element was constructed identically as Element 1C, except for the addition of the following highly ripened octahedra to the Pelloid Layer:

| | | |
|---|---|---|
| AgBr 0.983I0.017 0.9 μm | [30.00] | (3.23) |

Element 3E

This element was constructed identically as Element 1C, except for the addition of the following particles to the Pelloid Layer:

| | | |
|---|---|---|
| AgBr 0.8 μm cubes | [15.00] | (1.61) |

Element 4E

This element was constructed identically as Element 1C, except for the addition of the following particles to the Pelloid Layer:

| | | |
|---|---|---|
| AgBr 0.8 μm cubes | [30.00] | (3.23) |

Element 5C

This element was constructed identically as Element 1C, except for the addition of the infrared absorbing dye PL-3 to the Pelloid Layer:

| | | |
|---|---|---|
| PL-3 | [2.00] | (0.215) |

PL-3 anhydro-3,3'-bis(3-sulfobutyl)-10,12-ethylene-11-[4-(N,N-dimethylsulfamoyl)-1-piperazino]thiatricarbocyanine triethylamine salt.

Testing

The elements were exposed using a helium-neon laser emitting at 670 nm. Processing was conducted using a Kodak X-OMAT 480 RA™ processor, using the processing cycle, developer and fixer, previously described as the reference processing cycle.

All of the elements were successfully processed, except Element 1C, which was judged to lack sufficient specular density in the near infrared to allow reliable sensing of the presence of the element in the processor.

Specular Density

The specular and diffuse densities of the element reported in Table I were measured, with the following results:

TABLE I

| Element | Specular Density | Δ SD % | Diffuse Density | Δ DD % |
|---|---|---|---|---|
| 1C | 0.314 | — | 0.143 | — |
| 3E | 0.465 | 48 | 0.152 | 6.3 |
| 4E | 0.614 | 95.5 | 0.166 | 16 |
| 5C | 1.048 | 234 | 0.855 | 498 |

Table I illustrates the fundamentally different effects that infrared absorbing dye (5C) and silver halide particles have on density. The silver halide particles scattered infrared radiation efficiently, producing increases in specular density as compared to Element 1C, but producing only small increases in diffuse density as compared to Element 1C. On the other hand, the infrared absorbing dye increased diffuse density to a much larger degree than specular density.

The complexity of the infrared dye molecule as compared to the simplicity of the silver halide particles rendered the latter a clearly preferred approach to increasing specular density to permit the elements to be handled by the rapid access processor.

The invention has been described in detail with particular reference to preferred embodiments thereof, but it will be understood that variations and modifications can be effected within the spirit and scope of the invention.

What is claimed is:

1. An element capable of producing silver images having a maximum density of at least 3.0 in response to imagewise exposure to visible light and processing in a reference processing cycle, said element being comprised of a transparent film support and, coated on the support, hydrophilic colloid layers including, dispersed in at least one layer, compact radiation-sensitive silver halide grains (a) exhibiting a mean size of less than 0.5 μm, (b) containing less than 3 mole percent iodide, based on silver, and (c) coated at a total silver coating coverage of less than 50 $mg/dm^2$, WHEREIN the specular density of the element to infrared radiation in the wavelength range of from 850 to 1100 nm is increased by the presence of compact particles dispersed in at least one of the hydrophilic colloid layers positioned to receive imagewise exposure to visible light after at least one of the hydrophilic colloid layers containing said radiation-sensitive silver halide grains, said particles (a) being removable from the element during the reference processing cycle, (b) having a mean size of from 0.3 to 1.1 μm and at least 0.1 μm larger than the mean grain size of the radiation-sensitive grains, and (c) having an index of refraction at the wavelength of the infrared radiation that differs from the index of refraction of the hydrophilic colloid by at least 0.2, said reference processing cycle consisting of development 24 seconds at 35° C.

fixing 20 seconds at 35° C.

washing 20 seconds at 35° C.

drying 20 seconds at 65° C.

with up to 6 seconds being taken up in film transport between processing steps, development employing the following composition:

hydroquinone 30 g 1-phenyl-3-pyrazolidone 1.5 g

KOH 21 g $NaHCO_3$ 7.5 g $K_2SO_3$ 44.2 g $Na_2S_2O_3$ 12.6 g

NaBr 35.0 g 5-methylbenzotriazole 0.06 g glutaraldehyde 4.9 g water to 1 liter at a pH 10.0, and fixing employing the following composition:

$Na_2S_2O_3$ in water at 60% of total weight 260.0 g $NaHSO_3$ 180.0 g boric acid 25.0 g acetic acid 10.0 g water to 1 liter at a pH of 3.9–4.5.

2. An element according to claim 1 wherein the radiation-sensitive silver halide grains exhibit a mean size of less than 0.35 μm.

3. An element according to claim 1 wherein the particles exhibit a mean size in the range of from 0.5 to 0.9 μm.

4. An element according to claim 1 wherein the refractive index of the particles differs from that of the hydrophilic colloid in which the particles are dispersed by at least 0.4.

5. An element according to claim 1 wherein the particles are comprised of silver halide containing less than 3 mole percent iodide, based on silver.

6. An element according to claim 5 wherein only the radiation-sensitive grains are spectrally sensitized.

7. An element according to claim 5 wherein the radiation-sensitive grains are high chloride silver halide grains and the particles are high bromide silver halide particles.

8. An element according to claim 7 wherein the particles consist essentially of silver bromide.

9. An element according to claim 1 wherein the radiation-sensitive grains and the particles are coated on opposite sides of the support.

10. An element according to claim 9 wherein the particles are coated in a layer containing an antihalation dye.

11. An element according to claim 1 wherein the radiation-sensitive grains are coated in hydrophilic colloid layers on opposite sides of the support and the particles are coated in hydrophilic colloid layers on at least one side of the support, the particles being located in hydrophilic colloid layers that are located nearer the support than at least one overlying layer containing the radiation-sensitive silver halide grains.

* * * * *